United States Patent [19]

Arita

[11] 4,270,993

[45] Jun. 2, 1981

[54] METHOD OF STABILIZING AN ALUMINUM METAL LAYER IN AN ALUMINUM ELECTROLYTIC CELL

[75] Inventor: Youji Arita, Yokohama, Japan

[73] Assignee: Mitsubishi Light Metal Industries, Limited, Tokyo, Japan

[21] Appl. No.: 132,627

[22] Filed: Mar. 21, 1980

[30] Foreign Application Priority Data

Apr. 2, 1979 [JP] Japan ..... 54/39540

[51] Int. Cl.[3] ..... C25C 3/06; C25C 3/16

[52] U.S. Cl. ..... 204/67; 204/243 M

[58] Field of Search ..... 204/67, 243 M, 244, 204/243 R

[56] References Cited

U.S. PATENT DOCUMENTS

| | | | |
|---|---|---|---|
| 2,824,057 | 2/1958 | Thayer | 204/243 M |
| 3,385,778 | 5/1968 | Johnson | 204/243 M |
| 3,969,213 | 7/1976 | Yamamoto et al. | 204/243 M |
| 4,090,930 | 5/1978 | Morel et al. | 204/67 |

FOREIGN PATENT DOCUMENTS 40-12365 of 1965 Japan .

*Primary Examiner*—Howard S. Williams

*Attorney, Agent, or Firm*—Oblon, Fisher, Spivak, McClelland & Maier

[57] ABSTRACT

A method of stabilizing an aluminum metal layer in an aluminum electrolytic cell where, in the interior of rectangular container of aluminum electrolytic cell, cell currents supplied from anode buses in the upper part of said electrolytic cell are drawn out through plural collector bars provided parallel to end walls of said container, characterized by directing the direction of currents flowing through said collector bars to the longitudinal center line from side walls of said container in the neighborhood of said end walls and to said side walls from said longitudinal center line in the longitudinal central part of said container.

4 Claims, 8 Drawing Figures

METHOD OF STABILIZING AN ALUMINUM METAL LAYER IN AN ALUMINUM ELECTROLYTIC CELL

BACKGROUND OF THE INVENTION

The present invention relates to a method of stabilizing an aluminum metal layer in an aluminum electrolytic cell. More particularly, the present invention relates to a method of decreasing horizontal currents occurred in an aluminum metal layer in an aluminum electrolytic cell to prevent the fluctuation and upheaval of metal layer to thereby stabilize the metal layer.

The electrolytic production of aluminum is industrially carried out by connecting plural rectangular electrolytic cells in series by anode buses and cathode buses to make up a pet line and passing a large current of 50 to 250 KA therethrough to electrolyze alumina in the electrolytic bath with direct current. As a method of connecting these electrolytic cells, two typical types, that is, single entry type in which cell currents drawn out from the both sides of an electrolytic cell to cathode buses are supplied to anode buses of the second cell from one side thereof and double entry type in which cell currents drawn out to cathode buses are supplied to anode buses of the second cell from the both sides thereof have been known. In either case, a srong magnetic field is generated in the interior of electrolytic cell because cathode buses which a high electric current flows through passes the side of cell.

On the other hand, in the electrolytic cell, currents introduced from anode buses are led to an electrolytic bath through carbon anodes, further reach a cathode bed of carbon via an aluminum metal layer, thereafter are collected by plural collector bars provided parallel to the end walls of container and are withdrawn to cathode buses provided along the both side walls of container. The cell currents pass through a short circuit course which is lowest in electric resistance toward collector bars so that a part of cell current flowing through the central parts of cell comes to take directly a course directing to collector bars in the neighborhood of the side walls of container without taking a vertically downward course, and, as the result, horizontal currents directing to the side walls of container from the longitudinal center line thereof are produced in the cell, particularly in the aluminum metal layer.

The horizontal currents produced in the aluminum metal layer fluctuate the layer and heave the upper surface of the layer by an interaction with the above described magnetic field. When the aluminum metal layer becomes thus unstable the layer contacts sometimes with the lower surface of carbon anode and the cell currents comes to flow through the contacting part thereby the current efficiency decreases remarkably.

Then, as the result of studying on a method of stabilizing an aluminum metal layer, the present inventor has found that, if the direction of current flowing through collector bars is controlled to a specific direction, the horizontal currents in the aluminum metal layer decrease and so the aluminum metal layer can be effectively stabilized, and have attained the present invention.

SUMMARY OF THE INVENTION

One object of the present invention is to provide a novel method of stabilizing an aluminum metal layer in an electrolytic cell by preventing the fluctuation and upheaving of the aluminum metal layer.

Another object of the present invention is to provide a novel method of decreasing the displacement of interface between electrolytic bath and aluminum metal layer to maintain an appropriate anode-cathode distance in the operation of electrolytic cell.

Further anode object of the present invention is to provide a novel method for operating an electrolytic cell with high current efficiency.

According to the present invention, these objects have been accomplished by a method of stabilizing an aluminum metal layer in an aluminum electrolytic cell where cell currents supplied from anode buses in the upper part of said electrolytic cell are drawn out through plural collector bars provided parallel to end walls of container in the interior of rectangular container of aluminum electrolytic cell, characterized by directing the direction of currents flowing through said collector bars to the longitudinal center line from side walls of container in the neighborhood of said end walls and to said side walls from said longitudinal center line in the longitudinai central part of container.

DESCRIPTION OF THE PREFERRED EMBODIMENTS

The aluminum electrolytic cell in the present invention is rectangular in its horizontal cross-section and is provided with plural collector bars parallel to the end walls of container in the interior of steel container.

Figure 1:
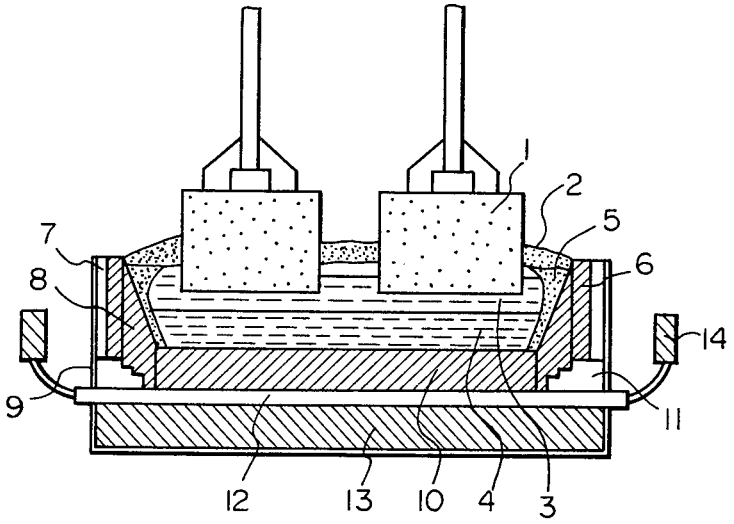
FIG. 1 is a schematic vertical cross-section of aluminum electrolytic cell.

FIG. 1 is a vertical cross-section showing one embodiment of conventional electrolytic cell to which the method of the present invention is applicable, in which 1 is a prebaked anode, 2 is alumina, 3 is an electrolytic bath, 4 is aluminum metal, 5 is a freeze, 6 is a carbon slab, 7 is an insulating brick in side wall, 8 is a carbon lining, 9 is a steel container, 10 is a cathode carbon block, 11 is an insulating brick, 12 is a collector bar, 13 is an insulating brick in bottom part and 14 is a cathode bus.

Figure 2:
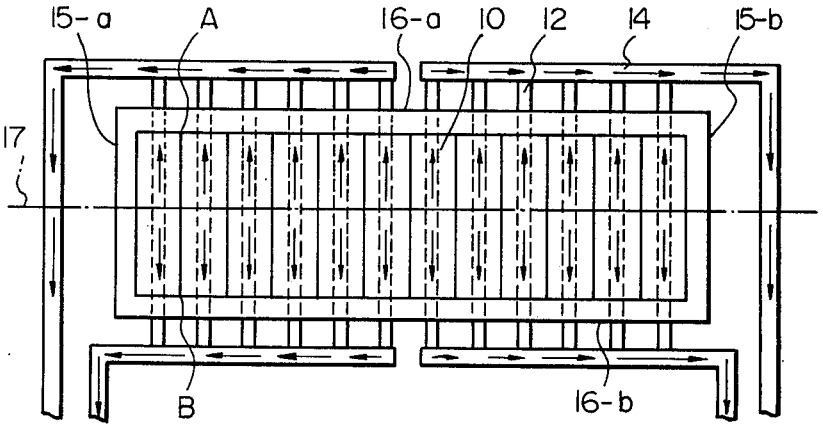
FIG. 2 and FIG. 3 are schematic horizontal cross-sections of electrolytic cell.
Figure 3:
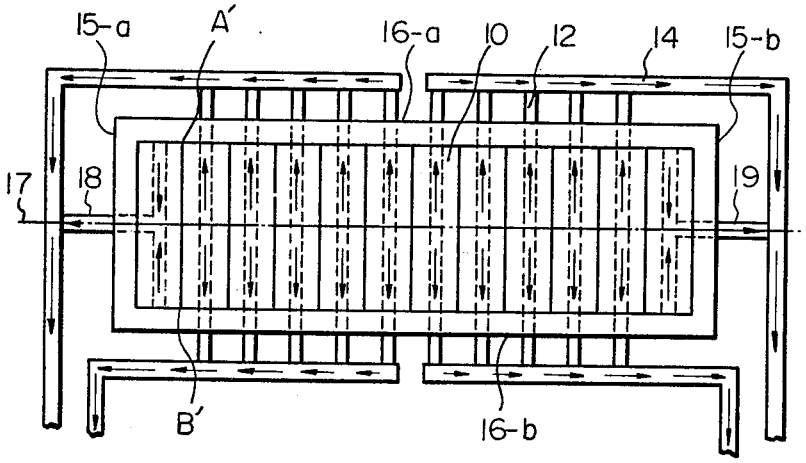

FIG. 2 is a horizontal cross-section in case the electrolytic cells shown in FIG 1 are arranged side-by-side in double entry type, and FIG. 3 is a horizontal cross-section of electrolytic cell in one example in case of applying the method of the present invention to the above described electrolytic cell. In FIG. 2 and FIG. 3, arrows indicate the directions of current travelling through the collector bars and cathode buses, and (15*a*) and (15*b*) are end walls of container and (16*a*) and (16*b*) are side walls of container, and 17 indicates the longitudinal center line of container. In the Method of the present invention, as shown in FIG. 3, the currents flowing through collector bars in the longitudinal central parts of container and the currents flowing through collector bars in the neighborhood of end walls of container are counter flowed by directing the direction of current flowing through the collector bars from the longitudinal center line 17 to the side walls (16*a*) and (16*b*) in the longitudinal central part of container, and from the side walls (16*a*) and (16*b*) to the longitudinal center line 17 in the neighborhood of end walls of container. The drawing out of current is performed through collector bars 12 perpendicularly extending to the side walls of container in the longitudinal central parts of container and performed through electrical conductive bars 18 and 19 extending from the central parts to the outside of cell in the neighborhood of the end walls of container.

As the result the currents flowing through the collector bars in the longitudinal central parts of container and the currents flowing through the collector bars in the neighborhood of the end walls of container interact, and thereby the concentration of current in the collector bar and cathode carbon block is reduced and the horizontal currents towards the direction of side walls of container in the aluminum metal layer decrease.

In order to direct the direction of current flowing through collector bars in the neighborhood of end walls of container from the side walls of container to the longitudinal center line thereof, for example the shape of collector bar is made to T-shape and the currents flowing through the collector bars are drawn out from the central parts of end walls of container to be introduced to the cathode buses through conductive bar. The currents flowing through the collector bars may be drawn out from the bottom of container.

The collector bars necessary to direct the direction of current from the side walls of container to the longitudinal center line thereof are collector bars in the neighborhood of end walls of container, particularly within the range from the end of side wall of container to the central parts of side wall by 15% of side distance.

It is decided suitably according to the state of occurrence of horizontal current whether collector bars in the neighborhood of either one end wall of container, or collector bars in the neighborhood of both end walls of container are chosen as the subject.

State of occurrence of horizontal current, the distribution of the vertical component of magnetic field and displacement of interface between aluminum metal layer and electrolytic bath were calculated on a type of electrolytic cell shown in FIG. 1 and FIG. 2 under the following condition:

| | |
|---|---|
| (1) Surface area of aluminum metal layer | $7^m \times 3^m$ |
| (2) Depth of aluminum metal layer | 20 cm |
| (3) Density of aluminum metal | 2.3 g/cm$^3$ |
| (4) Density of electrolytic bath | 2.1 g/cm$^3$ |
| (5) Specific resistance of cathode carbon block | $3.6 \times 10^{-3}\Omega$ . cm |
| (6) Specific resistance of collector bar | $1.3 \times 10^{-4}\Omega$ . cm |
| (7) Line current | 150 KA |
| (8) Height of cathode block | 40 cm |
| (9) Cross-sectional area of collector bar | 150 cm$^2$ |

Figure 4:
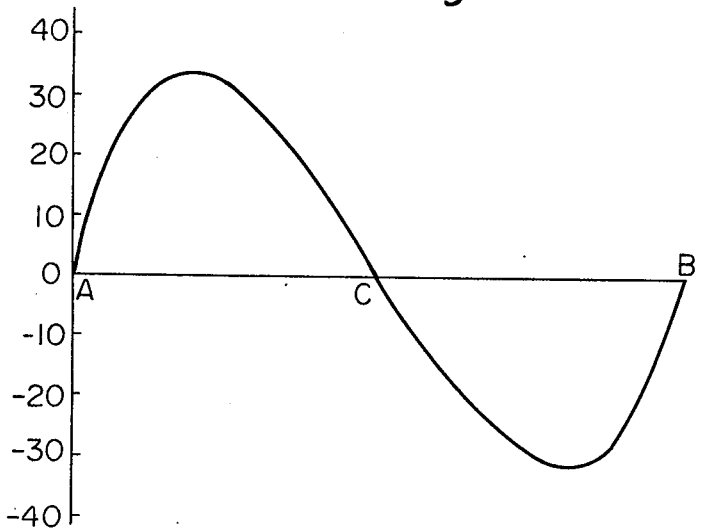
FIG. 4 and FIG. 7 are diagrams showing the distribution of horizontal currents in an aluminum metal layer.
Figure 5:
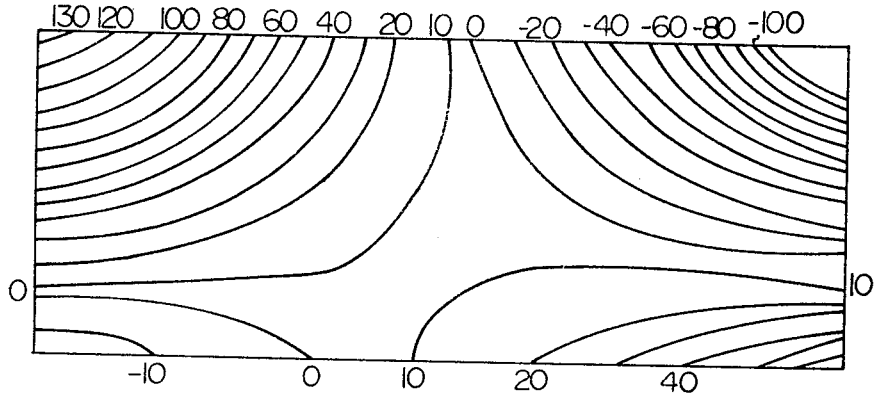
FIG. 5 is a diagram showing the distribution of the vertical component of magnetic field in an aluminum metal layer.
Figure 6:
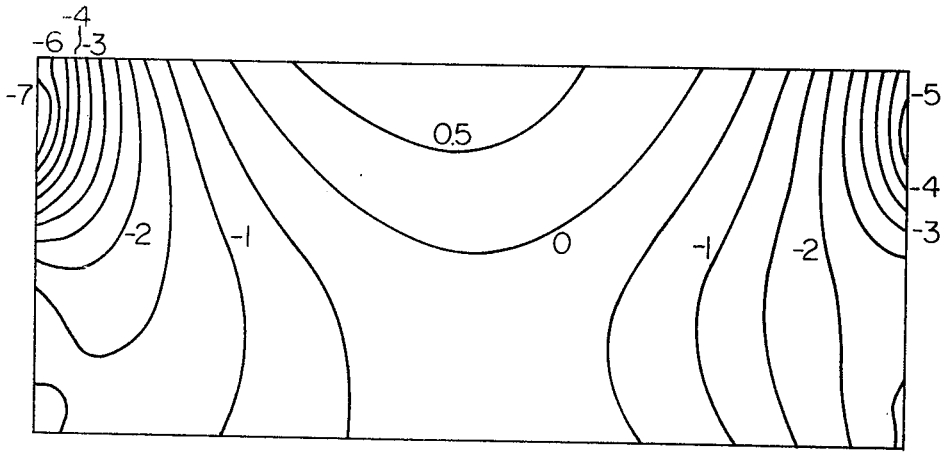
FIG. 6 and FIG. 8 are diagrams showing the displacement of interface between aluminum metal layer and electrolytic bath.

FIGS. 4 to 6 show the result of calculation.

FIG. 4 shows the distribution of horizontal current in the direction of A at line A—B of FIG. 2. The distance of line A—B and the end wall of container is 70 cm. Point C is a crossing point of line A—B and the longitudinal center line of container. Ordinate shows a horizontal current value (unit:ampere). Incidentally, in the calculation of the state of occurrence of horizontal current, the current density in the interface between aluminum metal layer and electrolytic bath was assumed to be uniform over all the area of aluminum metal surface.

FIG. 5 shows the distribution of the vertical component of magnetic field (unit:gauss) in the aluminum metal layer.

FIG. 6 shows a displacement (unit:centimeter) of interface between aluminum metal layer and electrolytic bath, but the displacement at the crossing point of the longitudinal center line of container and the transverse center line of the same is assumed to be 0 cm.

The displacement of interface between the aluminum metal layer and electrolytic bath was calculated using the following equation:

$$\frac{\partial^2\Phi}{\partial x^2} + \frac{\partial^2\Phi}{\partial y^2} = \frac{1}{g(\rho_2 - \rho_1)}\left(Jy\frac{\partial Bz}{\partial X} - Jx\frac{\partial Bz}{\partial Y}\right)$$

$\phi$: Displacement of interface between electrolytic bath and aluminum metal layer;

g: Acceleration of gravity;

$P_1$, $P_2$: Densities of electrolytic bath and aluminum metal;

Jx, Jy: Current densities in directions X and Y in the metal layer;

Bz: Z direction component of magnetic field;

x: Longitudinal direction of electrolytic cell;

y: Transverse direction of electrolytic cell;

z: Vertical direction of electrolytic cell.

(Refer to "Behavior of bath and molten metal in aluminum electrolytic cell" in "Kei-Kinzeku" (Journal of Japan Institute of Light Metals) Vol. 26, No. 11, 1976)

Next, the same calculation as described above was performed on the case of FIG. 3 in which the method of the present invention was applied to the above described electrolytic cell. The result is shown in FIG. 7 and FIG. 8.

Figure 7:
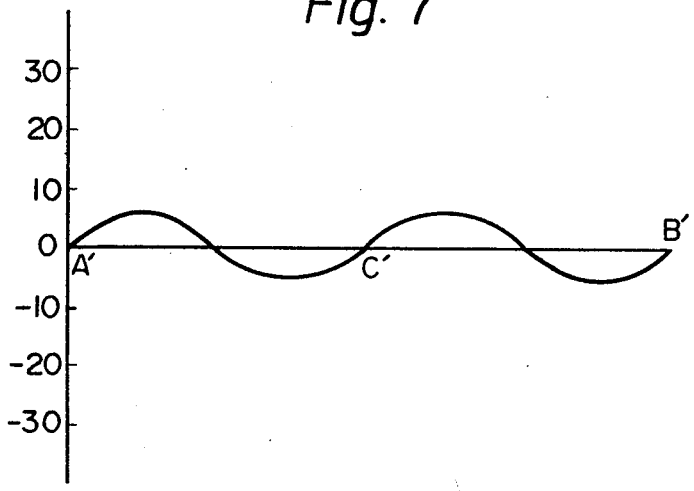

FIG. 7 corresponds to FIG. 4 and shows the distribution of horizontal current in the direction of A' at line A'-B' of FIG. 3. The distance of line A'—B' and the end wall of container is 70 cm. The method of calculation and the expression of result are the same as in case of FIG. 4.

Figure 8:
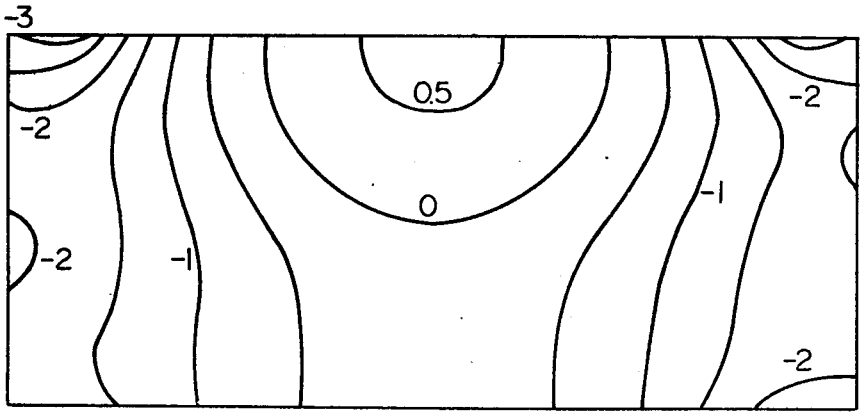

FIG. 8 corresponds to FIG. 6 and shows the displacement of interface between aluminum metal layer and electrolytic bath. The method of calculation and the expression of result are the same as in case of FIG. 6.

As is evident from contrast of FIG. 7 with FIG. 4 and FIG. 8 with FIG. 6, the horizontal currents towards the direction of side walls of container in the aluminum metal layer in the neighborhood of end walls of container can be remarkably decreased by applying the method of the present invention to the conventional type of electrolytic cell, and as the result the displacement of interface between electrolytic bath and aluminum metal layer can be effectively reduced.

As described above, according to the present invention, the electrolytic cell can be operated stably and with high current efficiency by maintaining an appropriate anode-cathode distance since the displacement of interface between electrolytic bath and aluminum metal layer can be reduced to prevent the aluminum metal layer from fluctuation.

What is claimed is:

1. A method of stabilizing an aluminum metal layer in an aluminum electrolytic cell where, in the interior of a rectangular container of an aluminum electrolytic cell, cell currents supplied from anode buses in the upper part of said electrolytic cell are drawn out through plural collector bars provided parallel to the end walls of said container, characterized by directing the direction of currents flowing through said collector bars to the longitudinal center line from the side walls of said container in the neighborhood of said end walls and to said side walls from said longitudinal center line in the longitudinal central part of said container.

2. The method as set forth in claim 1 wherein the direction of current flowing through the collector bars located within the range from the end of the side wall of the container to the longitudinal central parts of said side wall by 15% of the side distance is directed to the longitudinal center line from the side walls of said container.

3. The method as set forth in claim 1 wherein the currents flowing through the collector bars in the neighborhood of the end walls of the container are drawn out from the central parts of said end walls.

4. The method as set forth in claim 1 wherein said aluminum electrolytic cell is in a pot line of a side-by-side arrangement.

* * * * *